US009249063B2

(12) United States Patent
Marlin et al.

(10) Patent No.: US 9,249,063 B2
(45) Date of Patent: Feb. 2, 2016

(54) PYROTECHNIC GAS GENERATOR COMPOUNDS

(75) Inventors: Frédéric Marlin, Saint Medard en Jalles (FR); Stéphane Besombes, Martignas sur Jalle (FR)

(73) Assignee: HERAKLES, Le Haillan ( * ) Notice: Subject to any disclaimer, the term of this patent is extended or adjusted under 35 U.S.C. 154(b) by 96 days.

(21) Appl. No.: 14/115,005

(22) PCT Filed: May 9, 2012

(86) PCT No.: PCT/FR2012/051024

§ 371 (c)(1), (2), (4) Date: Jan. 10, 2014

(87) PCT Pub. No.: WO2012/153062

PCT Pub. Date: Nov. 15, 2012

(65) Prior Publication Data

US 2014/0116584 A1 May 1, 2014

(30) Foreign Application Priority Data

May 9, 2011 (FR) ..... 11 53976

(51) Int. Cl.

| | |
|---|---|
| ***C06B 25/00*** | (2006.01) |
| ***C06B 25/34*** | (2006.01) |
| ***D03D 23/00*** | (2006.01) |
| ***D03D 43/00*** | (2006.01) |
| ***C06B 33/14*** | (2006.01) |
| ***C06B 23/00*** | (2006.01) |
| ***C06D 5/06*** | (2006.01) |
| ***C06B 45/00*** | (2006.01) |

(52) U.S. Cl.

CPC ..... *C06B 33/14* (2013.01); *C06B 23/007* (2013.01); *C06B 45/00* (2013.01); *C06D 5/06* (2013.01)

(58) Field of Classification Search

USPC ..... 149/2, 88, 92, 109.4, 109.6

See application file for complete search history.

(56) References Cited

U.S. PATENT DOCUMENTS

| | | | | |
|---|---|---|---|---|
| 5,139,588 | A * | 8/1992 | Poole | C06B 29/16 149/61 |
| 5,608,183 | A * | 3/1997 | Barnes | C06B 31/00 149/36 |
| 6,132,537 | A | 10/2000 | Zeuner et al. | |
| 6,143,102 | A * | 11/2000 | Mendenhall | C06B 23/007 149/109.6 |
| 6,740,180 | B1 * | 5/2004 | Cesaroni | C06B 45/10 149/19.91 |
| 8,216,402 | B2 | 7/2012 | Gaudre et al. | |
| 2005/0189052 | A1 | 9/2005 | Zeuner et al. | |
| 2007/0163457 | A1 * | 7/2007 | Matsumura | F42B 3/195 102/202.7 |
| 2011/0041969 | A1 * | 2/2011 | Marlin | C06B 29/22 149/19.5 |

FOREIGN PATENT DOCUMENTS

| | | |
|---|---|---|
| DE | 19531130 | 2/1997 |
| EP | 0584899 | 3/1994 |
| EP | 0949225 | 10/1999 |
| EP | 1006096 | 6/2000 |
| EP | 1342705 | 9/2003 |
| EP | 1568673 | 8/2005 |
| EP | 2407443 | 1/2012 |
| JP | 2009-137821 | 6/2009 |
| WO | WO 2006/134311 | 12/2006 |
| WO | 2010/103811 | 9/2010 |

OTHER PUBLICATIONS

Translation of Chinese Office Action, Jul. 2, 2015; Chinese Patent Application No. 201280022724.5 (8 pages).

* cited by examiner

*Primary Examiner* — James McDonough

(74) *Attorney, Agent, or Firm* — Hamre, Schumann, Mueller & Larson P.C.

(57) ABSTRACT

The main subject of the present invention is solid pyrotechnic gas generator compounds, the composition of which contains: guanidine nitrate, basic copper nitrate, and at least one inorganic titanate, the melting point of which is above 2100 K. Said compounds are perfectly suitable for use in frontal airbags.

17 Claims, No Drawings

PYROTECHNIC GAS GENERATOR COMPOUNDS

The present invention relates to gas-generating pyrotechnic compounds (or pyrotechnic objects) which have, simultaneously, a moderate combustion temperature (below 2200 K) and a high rate of combustion (greater than or equal to 20 mm/s at 20 MPa) and which generate combustion residues in agglomerate form, the residues thus being readily filterable.

Said gas-generating pyrotechnic compounds are particularly suitable for use in systems for protecting the occupants of motor vehicles, more especially for inflating the front airbags (see below).

The technical field relating to the protection of the occupants of motor vehicles has undergone a very substantial expansion in the last twenty years. The latest generation of vehicles now incorporate in the cabin several security systems of airbag type, the functioning of which is ensured by the combustion gases of pyrotechnic compounds. Among the systems of airbag type, front airbags (for the driver or passenger) and side airbags (curtain, chest protection) are distinguished.

Front airbags differ from side airbags essentially in the time required for the deployment and establishment of the airbag. Typically, this time is longer for a front airbag (about 40-50 ms, as opposed to 10-20 ms for a side airbag).

Front airbag systems essentially make use of gas generators that are said to be entire pyrotechnic, including at least one pyrotechnic charge consisting of at least one pyrotechnic compound (object). This type of design in return demands that the pyrotechnic compound be able to satisfy all of the following requirements:

1) first, the gas yield of such a pyrotechnic compound (i.e. the amount of gas generated by combustion), expressed in mol/g, must be high so as to lead to high inflating power;

2) such a pyrotechnic compound must have a surface inflating flow rate value (which flow rate is estimated by the product $\rho \times n \times Tc \times Vc$, where $\rho$ is the weight per unit volume of the pyrotechnic compound (expressed in $g/cm^3$), n is the molar gas yield of the combustion (expressed in mol/g), Tc is the combustion temperature (expressed in Kelvin) and Vc is the rate of combustion (expressed in mm/s)) for inflating the bag over the required period. Thus, for a front airbag, the functional inflation need of the bag over a time of about 40-50 ms imposes recourse to a pyrotechnic compound having a sufficiently high rate of combustion. A rate of combustion of about 15 mm/s at 20 MPa and more advantageously greater than or equal to 20 mm/s at 20 MPa is sufficient to design and manufacture a suitable charge;

3) in order to ensure a satisfactory establishment of the system, the pyrotechnic compound must also have good lightability characteristics. The difficulty in lighting is exacerbated by the high initial surface of the charge induced by its geometry of multi-pellet type; there is therefore an advantage in the charge being able to be in the form of pellets of sufficiently high dimension (ideally pellets with a diameter of greater than or equal to 5 mm);

4) given the generally tapering surface profile of the employed charges (of multi-pellet type), the pyrotechnic compound must have a rate of combustion that is stable and sufficiently high at low pressure, ideally nonzero at atmospheric pressure, so as to avoid the risks of extinction at the end of functioning, leading to incomplete combustion of the charge of the pellets. The compound must also have a low pressure exponent at medium and high pressure (typically less than or equal to 0.5), but also at low pressure. A low pressure exponent in point of fact makes it possible very significantly to reduce the variability of functioning of the compound in the field of use of the gas generator. The reproducibility of functioning is thereby improved and the dimension of the metal structure of the generator may be advantageously reduced;

5) the gases generated by combustion of the pyrotechnic compound must be nontoxic, i.e. they must have a low content of carbon monoxide (CO), ammonia ($NH_3$) and nitrogen oxides (NOx). This constraint is most particularly important for a driver or passenger front generator which may contain between 40 g and 80 g of pyrotechnic compound. Moreover, the highly tapering nature of the combustion surface, in the context of a charge with multi-pellet type geometry, induces a long combustion tail at low pressure. This long combustion tail at low pressure is the source of emission of the majority of toxic species present in the gases serving to inflate the airbag. To overcome this problem, it is thus advantageous to have a pyrotechnic compound which has a nonzero rate of combustion at atmospheric pressure;

6) the combustion temperature of said pyrotechnic compound must not be too high in order for the temperature of the gases in the airbag to remain low enough not to harm the physical integrity of the occupant. Preferentially, a combustion temperature value of less than 2200 K and ideally less than 2000 K is required. Moreover, a low combustion temperature makes it possible firstly to limit the thickness of the bag, and secondly to simplify the design of the gas generator by making it possible to reduce the presence of chicanes and filters therein. Overall, the gas generator has a reduced weight and volume, for a lower cost;

7) finally, what is more, there are constraints associated with the amount of solid particles generated by combustion of the compound, which must remain low. Said solid particles are liable to be expelled from the gas generator during functioning and to constitute hot points that may damage the inner wall of the airbag.

Thus, a person skilled in the art is in search of pyrotechnic compounds that simultaneously have:

- a moderate combustion temperature (below 2200 K);
- a sufficiently high rate of combustion (ideally greater than or equal to 20 mm/s at 20 MPa) with a low pressure exponent at medium and high pressure (less than 0.5);
- a limit operating pressure of less than or equal to atmospheric pressure or, more advantageously, a nonzero rate of combustion at atmospheric pressure (ideally greater than or equal to 1 mm/s);
- a sufficiently low level of solid particles generated by the combustion;

in order for said compounds to be suitable for use in entirely pyrotechnic gas generators intended for front airbags.

Various types of pyrotechnic composition, for obtaining gas-generating pyrotechnic compounds that are particularly suitable for use in systems for protecting the occupants of motor vehicles, have already been proposed to date. At the present time, for front airbags, the pyrotechnic compounds that appear to offer the best compromise, in terms of combustion temperature, gas yield, toxicity of the combustion gases and pyrotechnic safety of implementation, contain in their composition as main ingredients guanidine nitrate (GN) as reductive charge and basic copper nitrate (BCN) as oxidizing charge. The use of the GN/BCN couple makes it possible to obtain a low combustion temperature, typically of about 1800 K. U.S. Pat. No. 5,608,183 describes compounds of this type, obtained via a wet-route manufacturing process. However, these compounds remain difficult to ignite and intrinsically have a rate of combustion at best equal to 20 mm/s at 20 MPa.

With a view to improving the rate of combustion, it has been proposed, according to the prior art, to incorporate additives, based on a transition metal oxide, acting as ballistic catalyst. Such additives are well known to those skilled in the art, in that they are traditionally used in the field of propellants (as ballistic catalyst) for increasing the rate of combustion, not only at low and medium pressure but also at high pressure. U.S. Pat. No. 6,143,102 thus describes the incorporation of a ballistic catalyst, consisting of an oxide chosen from $Al_2O_3$, $TiO_2$, ZnO, MgO and $ZrO_2$, at a weight content of from 0.5% up to 5%. In patent applications EP 1 342 705 and EP 1 568 673, metal oxides and hydroxides, acting as ballistic catalyst (termed combustion adjusters) are also cited, such as $Cr_2O_3$, $MnO_2$, $Fe_2O_3$, $Fe_3O_4$, CuO, $Cu_2O$, CoO, $V_2O_5$, $WO_3$, ZnO, NiO, $Cu(OH)_2$. They may be incorporated at up to 10% by weight.

Moreover, a person skilled in the art knows that pyrotechnic compounds formulated with basic copper nitrate (BCN) have the major drawback of generating, during combustion, a high proportion of solid residues that are not readily filterable. This low filterability arises from the fact that the copper residues, in liquid form at the combustion temperature in the gas generator, intrinsically have mediocre agglomeration and can be readily entrained with the flow of combustion gases to solidify at the outlet of said generator. The resulting hot solid particles are then liable to damage the wall of the airbag. Due to the high proportion of BCN in the pyrotechnic compounds described previously, it is consequently necessary to equip the gas generator with a sizable filter system in order to ensure satisfactory uptake of the copper particles, this being to the detriment of the dimensioning, weight and thus cost of the gas generator.

In response to this technical problem of uptake of solid copper particles, it has been proposed, according to the prior art, to incorporate into the composition of pyrotechnic compounds an additive (slagging agent or agglomerating agent) whose function is to agglomerate the copper residues generated by the combustion. This results, at the end of combustion, in an agglomerate which is in the form of a skeleton of the initial pyrotechnic block, which may then be readily taken up by the filtration system of the gas generator. Thus, U.S. Pat. No. 6,143,102 and patent applications EP 1 342 705 and EP 1 568 673 also describe the use of an agglomerating agent, such as $SiO_2$, $Si_3N_4$, SiC or clay, in addition to a ballistic catalyst additive, in weight proportion that may also range from 0.5% to 5%, or even 10%.

Finally, according to the teaching of said U.S. Pat. No. 6,143,102 and said patent applications EP 1 342 705 and EP 1 568 673, the first additive (acting as ballistic catalyst) and the second additive (which ensures the agglomeration of the copper residues) may represent up to 10%, or even 15%, by weight of the composition of the compound, which contributes toward a detrimental decrease in the gas yield value of said composition.

According to another approach, for the purpose especially of improving the retention of the solid residues, it has been proposed, according to the prior art, to reduce the combustion temperature and/or the proportion of BCN in favor of another oxidizing charge. Patent applications EP 0 949 225 and EP 1 006 096 thus describe compositions which contain, as main ingredients, a reductive charge consisting of or containing a guanidine derivative and an oxidizing charge containing BCN and a metal oxide, combined with a chlorate, perchlorate and/or nitrate. The metal oxide, introduced at a high weight proportion (20% to 70%, or even 80%, by weight relative to the total weight of oxidizing charge) acts as a fully-fledged oxidizing charge. It contributes toward regulating overall the oxygen balance of the composition. Said metal oxide generally consists of CuO, but other oxides such as $Cr_2O_3$ and $MnO_2$ are mentioned.

The prior art thus describes compositions of gas-generating pyrotechnic compounds incorporating, as main ingredients, GN and BCN and containing two types of additive: a combustion catalyst (consisting of a metal oxide) and an agglomerating agent (such as $SiO_2$, or silicon nitride or carbide). It also describes compositions containing GN and BCN along with a high proportion of metal oxide, as oxidizing charge in substitution (partial, or even total) for said BCN.

Moreover, compositions which may incorporate a strontium derivative, such as SrO, $SrCO_3$, $Sr(OH)_2$ or $SrTiO_3$, are described in patent application JP 2009 137 821. These compositions contain a reducing agent, an oxidizing agent, a binder, a phosphorus agent for reducing the combustion temperature and a strontium derivative whose role is to limit the production of phosphorus oxide during combustion. Additives of the type such as those mentioned previously may also be present in the composition. These compositions are not of the type of those of the invention. The teaching of said document does not in any way suggest the dual function of $SrTiO_3$ within the compositions of the compounds of the invention (see below).

Starting from the known performance qualities of guanidine nitrate (GN)/basic copper nitrate (BCN) mixtures, the inventors wished to propose improved pyrotechnic compounds (improved pyrotechnic objects) that are most particularly suitable for use in front airbags. More specifically, the inventors wished to propose pyrotechnic compounds in the composition of which the presence of only one (type of) bifunctional additive (with a low proportion, i.e. with a limited incidence on the gas yield) makes it possible simultaneously to satisfy the technical problem of the agglomeration of the combustion residues and that of obtaining a high rate of combustion (in the present case at least as high as that of the prior art compounds described in U.S. Pat. No. 6,143,102).

It has been found that the presence, within the composition of the compounds of the invention, of a low proportion (low weight percentage) of only one type of additive (advantageously of a single additive of this type), of refractory nature, makes it possible to satisfy the improvement concern sought by the inventors, namely the combined obtention of an agglomerating effect on the combustion residues of BCN and a high rate of combustion (as high as that of the prior art compounds), while at the same time conserving a moderate combustion temperature.

Thus, the composition of the gas-generating pyrotechnic compounds (objects) of the present invention (which are most particularly suitable for front airbag applications) containing:

- guanidine nitrate (as reductive charge),
- basic copper nitrate (as oxidizing charge), and
- at least one (a bifunctional additive consisting of) inorganic titanate whose melting point is greater than 2100 K.

The gas-generating pyrotechnic solid compounds (objects) of the invention are of the GN/BCN conventional basis type and their composition contains, characteristically, at least one inorganic titanate whose melting point is greater than 2100 K. Said at least one inorganic titanate acts as an agglomerating agent for the solid combustion residues and as a ballistic catalyst.

Said at least one titanate is a refractory compound, whose melting point (greater than 2100 K) is significantly higher than the combustion temperatures of the GN/BCN bases in which it is present. Thus, it conserves its pulverulent solid physical state (it obviously participates in this form) at the combustion temperature, which is a necessary characteristic for obtaining an agglomerating effect on the liquid copper residues.

In support of the above assertion according to which said at least one titanate is a refractory compound, whose melting point is significantly higher than the combustion temperatures of the GN/BCN bases in which it is present, the following is pointed out. The combustion temperature of any GN/BCN base is in fact always below 1950 K. By way of illustration, it may be indicated here that a GN (53.7% by weight)/BCN (46.3% by weight) base, having an oxygen balance value of −3.3%, has a combustion temperature of 1940 K at 20 MPa and of 1941 K at 50 MPa. The maximum combustion temperature of a GN/BCN base is obtained for a ratio of 53.5% by weight of GN and 46.5% by weight of BCN, having an oxygen balance value of −3.2%, it has a value of 1942 K at 20 MPa, and 1943 K at 50 MPa. This moreover confirms the fact that the combustion temperature is not liable to vary by more than a few degrees Kelvin with the operating pressure of the gas generator, and always remains below 1950 K, irrespective of the operating pressure of the gas generator. Thus, the required value, above 2100 K, for the melting point of said at least one titanate (novel bifunctional additive of the compositions of the compounds of the invention) is always significantly higher (by at least 150 K) than the maximum combustion value of a GN/BCN base.

The at least one inorganic titanate, whose melting point is greater than 2100 K, present in the composition of the compounds of the invention, is advantageously chosen from metal titanates, alkaline-earth metal titanates and mixtures thereof. It very advantageously consists of a metal titanate or an alkaline-earth metal titanate.

Preferably, the composition of the compounds of the invention contains strontium titanate ($SrTiO_3$) and/or calcium titanate ($CaTiO_3$) and/or aluminum titanate ($Al_2TiO_5$). In a particularly preferred manner, it contains strontium titanate ($SrTiO_3$), calcium titanate ($CaTiO_3$) or aluminum titanate ($Al_2TiO_5$).

The at least one bifunctional additive of the invention (inorganic titanate) is generally present at between 1% and 5% (limits inclusive) by weight, advantageously between 2% and 4% by weight (limits inclusive) in the (weight) composition of the compounds of the invention.

The composition of the compounds of the invention is generally free of binder (preferred variant). Specifically, the rheoplastic behavior of guanidine nitrate in principle makes the presence of any binder superfluous, especially for obtaining, via a dry route, formed pyrotechnic objects, granules, pellets and compressed monolithic blocks (see below). However, the presence of such a binder cannot be absolutely excluded. The compounds of the invention incorporating a binder may especially exist in the form of monolithic blocks obtained by extrusion, optionally via a wet route.

The ingredients of the above three types (guanidine nitrate, basic copper nitrate, bifunctional additive(s)=inorganic titanate(s)) generally represent more than 99.5% by weight of the composition of the pyrotechnic compound. The ingredients of the above three types may entirely represent 100% by weight of the total weight of the compounds of the invention. The optional presence of at least one other additive, chosen, for example, from manufacturing auxiliaries (calcium stearate, graphite, silica in particular) is expressly envisioned in a proportion of less than 0.5% by weight. Such at least one other additive does not consist of a binder. The ingredients of the above three types (guanidine nitrate, basic copper nitrate, bifunctional additive(s)) thus generally represent more than 99.5% by weight of the composition of the pyrotechnic compound which is free of binder.

The composition of the compounds of the invention advantageously contains, expressed as weight percentages:

- from 45% to 60% of guanidine nitrate,
- from 37% to 52% of basic copper nitrate, and
- from 1% to 5%, advantageously 2% to 4%, of at least one inorganic titanate whose melting point is greater than 2100 K (bifunctional additive).

Such an advantageous composition is, as indicated above, generally free of binder (preferred variant).

The preferred bifunctional additives according to the invention, strontium titanate ($SrTiO_3$), calcium titanate ($CaTiO_3$) and aluminum titanate ($Al_2TiO_5$), thus have refractory nature (their melting point is, respectively, 2353 K, 2248 K and 2133 K, i.e. significantly higher than the combustion temperature of the GN/BCN base, which is always below 1950 K (see above)). Thus, these additives conserve their pulverulent solid physical state (they obviously participate in this form) at the combustion temperature of the composition, which is a necessary characteristic for obtaining an agglomerating effect on the liquid copper residues.

It is thus understood that, in the context of the present invention, the dual function of the additive is, firstly, to sufficiently agglomerate the combustion residues (doing so by increasing the viscosity of the condensed phase consisting of liquid copper) so as to facilitate their filterability (in order to be able to reduce the gas-generating filtration systems), and, secondly, to give the pyrotechnic compound the necessary ballistic properties for the functional need, namely:

- a rate of combustion equal to or even greater than that of the compounds of the prior art;
- a low pressure exponent;
- a nonzero and self-maintained combustion at atmospheric pressure.

Preferably, said at least one bifunctional additive is in a fine pulverulent form (of micrometric size, advantageously of nanometric size); with a medium diameter of less than 5 μm, and advantageously less than 1 μm. It advantageously has a specific surface area of greater than 1 $m^2/g$ (advantageously greater than 5 $m^2/g$ or more).

Guanidine nitrate is preferred as reducing agent, inter alia for reasons of pyrotechnic safety and for its rheoplastic behavior, suited to the implementation of the compacting and pelletizing phases of a dry-route process (see below), ensuring good densification of the starting pulverulent pyrotechnic composition while at the same time limiting the compression effort to be applied. The manufacture of compounds of the invention via a dry-route process may comprise up to four main steps (see below), which have especially been described in patent application WO 2006/134 311.

The at least one additive (bifunctional, chosen from inorganic titanates whose melting point is greater than 2100 K) advantageously participates with the other constituent ingredients, GN+BCN mainly, or even exclusively (at the start of the manufacturing process) or is added, further downstream, in the process for manufacturing the compounds of the invention.

The pyrotechnic compounds of the invention may also be obtained according to a wet-route process. According to one variant, said process comprises the extrusion of a paste containing the constituents of the compound. According to another variant, said process includes a step of placing in aqueous solution all or some main constituents comprising dissolution of at least one of the main constituents (reducing agent) followed by the production of a powder by drying by atomization, the addition to the powder obtained of the constituent(s) that have not been dissolved, and then the forming of the powder in the form of objects via the usual dry-route processes.

The preferential process for obtaining the pyrotechnic compounds of the invention (dry-route process) includes a step of dry-compacting of a mixture of the constituent ingredients in powder form of said compounds (with the exception, optionally, of said at least one additive which may be added later). The dry compacting is generally performed, in a manner known per se, in a roll compactor, at a compacting pressure of between $10^8$ and $6 \cdot 10^8$ Pa. It may be performed according to different variants (with a characteristic step of "simple" compacting followed by at least one additional step or with a characteristic step of compacting coupled with a forming step).

Thus, the pyrotechnic compounds (pyrotechnic objects) of the invention are capable of existing in various forms (especially in the course of the manufacturing process leading to the final compounds):

- after a dry compacting coupled with forming (by using at least one compacting roll, whose outer surface has alveolae), flakes with relief patterns are obtained, which can be broken for the direct production of formed pyrotechnic objects;
- after a dry compacting ("simple" compacting) followed by granulation, granules are obtained;
- after a dry compacting ("simple" compacting) followed by granulation and then pelletizing (dry compression), pellets or compressed monolithic blocks are obtained;
- after a dry compacting ("simple" compacting) followed by granulation and then by mixing of the granules obtained with an extrudable binder and extrusion of said binder charged with said granules, extruded monolithic blocks (charged with said granules) are obtained. It is understood that this process variant is not preferred insofar as it involves a binder.

The pyrotechnic compounds of the invention are thus especially capable of existing in the form of objects of the following types:

- granules;
- pellets;
- monolithic blocks (compressed or extruded, advantageously compressed).

The pyrotechnic compounds of the invention may also be obtained via a dry route by simple pelletizing of the powder obtained by mixing the constituents thereof.

In an entirely nonlimiting manner, it may be indicated here:

- that the granules of the invention generally have a particle size (median diameter) between 200 and 1000 μm (and also an apparent weight per unit volume of between 0.8 to 1.2 g/cm$^3$);
- that the pellets of the invention generally have a thickness of between 1 and 6 mm.

When the compounds of the invention are obtained via a dry-route process, the constituent ingredients of the compounds of the invention advantageously have a fine particle size, of less than or equal to 20 μm. Said particle size (median diameter value) is generally between 1 and 20 μm. The compounds described in the present invention express their full potential if they are obtained via a dry-route process from powders with a median diameter of between 5 and 15 μm for guanidine nitrate, between 2 and 7 μm for basic copper nitrate and between 0.5 and 5 μm for the at least one bifunctional additive.

According to another of its objects, the present invention relates to a pulverulent composition (mixture of powders), which is a precursor of a compound of the invention, the composition of which thus corresponds to that of a compound of the invention (see above).

According to another of its objects, the present invention relates to gas generators containing a gas-generating pyrotechnic solid charge; said charge containing at least one pyrotechnic compound of the invention. Said generators, especially charged with pellets of the invention, are entirely suitable for airbags, especially front airbags (see above).

It is now proposed to illustrate the invention in an entirely nonlimiting manner.

A. Table 1 below shows three examples (Ex. 1, Ex. 2 and Ex. 3) of composition of compounds of the present invention, and also the performance of said compounds compared with that of a prior art compound (Ref. 1) according to U.S. Pat. No. 6,143,102 (said compounds of the invention and of the prior art were manufactured via a dry-route process).

The compounds were evaluated by means of thermodynamic calculations or from physical measurements conducted on granules or pellets manufactured from the compositions via the process of mixing powders-compacting-granulation-and optionally dry-route pelletization.

Reference compound 1 (Ref. 1) of the prior art contains guanidine nitrate, basic copper nitrate and an aluminum oxide ($Al_2O_3$) as ballistic catalyst and silica ($SiO_2$) as agglomerating additive ("slagging" additive).

The compounds of examples 1 to 3 contain in their composition, in addition to the two constituents guanidine nitrate and basic copper nitrate of reference 1, a single bifunctional additive as described in the present invention.

The proportions of the constituents were adjusted so as to conserve an oxygen balance value of close to −3.3%, so as to be able directly to compare the performance of these compounds.

The results of examples 1 and 2 of table 1 show that the addition, in a moderate proportion (weight content of 4%), of an additive, strontium titanate ($SrTiO_3$) or calcium titanate ($CaTiO_3$), to a composition of the type such as that of reference compound 1, leads to the production of agglomerated combustion residues (in the form of a skeleton of the pyrotechnic block) and, to a combustion rate value over the pressure range 10 MPa-20 MPa higher than, a pressure exponent value lower than, a surface inflation flow rate value higher than, those of the reference compound 1 of the prior art.

The results of example 3 of table 1 show that the addition, in a lowered proportion (weight content of 2.7%) of calcium titanate ($CaTiO_3$) relative to example 2 (weight content of 4%), improves the performance (increase in the combustion rate value over the range 10-20 MPa, in the gas yield value and finally in the surface inflation flow rate value) relative to those of the compound according to example 2, while at the same time making it possible to conserve an agglomeration quality of the combustion residues that satisfactorily meets the functional need.

TABLE 1

| Examples | | Ref. 1 | Ex. 1 | Ex. 2 | Ex. 3 |
|---|---|---|---|---|---|
| Ingredients | | | | | |
| Guanidine nitrate (GN) | % | 52.3 | 52 | 52 | 52.7 |
| Basic copper nitrate (BCN) | % | 44.5 | 44 | 44 | 44.6 |
| Alumina ($Al_2O_3$) | % | 2.7 | — | — | — |
| Silica ($SiO_2$) | % | 0.5 | — | — | — |
| Strontium titanate ($SrTiO_3$) | | | 4 | — | — |
| Calcium titanate ($CaTiO_3$) | % | — | — | 4 | 2.7 |
| Characteristics | | | | | |
| Oxygen balance | % | −3.3 | −3.3 | −3.3 | −3.3 |
| Combustion temperature at 20 MPa | K | 1897 | 1889 | 1892 | 1905 |
| Density | g/cm$^3$ | 1.99 | 2.01 | 2.00 | 1.98 |
| Gas yield at 1 bar-1000K | mol/kg | 29.4 | 29.2 | 29.2 | 29.6 |
| Residue content at 1 bar-1000K | % | 26.7 | 27.3 | 27.3 | 26.3 |
| Rate of combustion at 10 MPa | | 16.3 | 16.5 | 16.6 | 17.0 |
| Rate of combustion at 20 MPa | mm/s | 21.3 | 22.7 | 21.8 | 22.5 |
| Pressure exponent (range 7 to 35 MPa) | | 0.37 | 0.28 | 0.23 | 0.20 |
| Rate of combustion at atmospheric pressure (1) | mm/s | 1.2 | 1.1 | 1.0 | 1.0 |
| Surface inflation flow rate ($\rho \times n \times T_c \times V_c$) at 20 MPa | mol · K/cm$^2$ · s | 236 | 252 | 241 | 251 |
| Agglomerated aspect of the combustion residues in the form of a skeleton of the pyrotechnic block (2) | | yes | yes | yes | yes |

(1) value measured on granules in a manometric chamber (as strand burner straw)

(2) after firing in a 40 cm$^3$ manometric chamber; pyrotechnic compound in the initial form of pellets 6.35 mm in diameter and 2.1 mm thick.

B. Table 2 below demonstrates that the benefit observed with strontium titanate or calcium titanate is indeed the result of a selection and cannot be systematically obtained by the use of just any refractory constituent (also other than the constituents described in the prior art), such as lanthanum oxide $La_2O_3$ (melting point of 2590 K), or by the use of another constituent of titanate type such as barium titanate $BaTiO_3$ (melting point of 1895 K). No cumulative effect of agglomeration of the combustion residues and production of a combustion rate value that is sufficient to be of interest is observed with these two additives.

TABLE 2

| Examples | | CEx. 1 | CEx. 2 |
|---|---|---|---|
| Ingredients | | | |
| Guanidine nitrate (GN) | % | 51.5 | 52 |
| Basic copper nitrate (BCN) | % | 43.5 | 44 |
| Lanthanum oxide ($La_2O_3$) | % | 5 | — |
| Barium titanate ($BaTiO_3$) | % | — | 4 |
| Characteristics | | | |
| Rate of combustion at 10 MPa | mm/s | 14.2 | 16.5 |
| Rate of combustion at 20 MPa | mm/s | 18.0 | 21.9 |
| Agglomerated aspect of the combustion residues in the form of a skeleton of the pyrotechnic block (1) | | no | no |

(1) after firing in a 40 cm$^3$ manometric chamber; pyrotechnic compound in the initial form of pellets 6.35 mm in diameter and 2.1 mm thick.

The invention claimed is:

1. A gas-generating pyrotechnic solid compound, the composition of which contains:

guanidine nitrate, basic copper nitrate, and at least one inorganic titanate whose melting point is greater than 2100 K, selected from the group consisting of strontium titanate ($SrTiO_3$), calcium titanate ($CaTiO_3$) and aluminum titanate ($Al_2TiO_5$).

2. The compound as claimed in claim 1, wherein its composition, expressed as weight percentages, contains between 1% and 5% of said at least one inorganic titanate.

3. The compound as claimed in claim 1, wherein its composition consists, for at least 99.5% by weight, of said guanidine nitrate, basic copper nitrate and inorganic titanate(s).

4. The compound as claimed in claim 1, wherein its composition, expressed as weight percentages, contains:

45% to 60% of guanidine nitrate,

37% to 52% of basic copper nitrate, and

1% to 5% of said at least one inorganic titanate whose melting point is greater than 2100 K.

5. The compound as claimed in claim 1, wherein said at least one inorganic titanate has a median diameter of less than 5 μm.

6. The compound as claimed in claim 1, which is obtained via a dry-route process, which comprises a step of compacting of a pulverulent mixture containing its constituent ingredients in powder form, optionally followed by a granulation step, which is itself optionally followed by a step of forming by pelletization.

7. The compound as claimed in claim 1, which is in the form of granules, pellets or monolithic blocks.

8. A pulverulent composition, which is a precursor of a compound as claimed in claim 1, the composition of which corresponds to that of a compound as claimed in claim 1.

9. A gas generator, containing a gas-generating pyrotechnic solid charge, wherein said charge contains at least one compound as claimed in claim 1.

10. The compound as claimed in claim 1, wherein its composition, expressed as weight percentages, contains between 2% and 4% of said at least one inorganic titanate.

11. The compounds as claimed in claim 1, wherein its composition consists for 100% by weight of said guanidine nitrate, basic copper nitrate and inorganic titanate(s).

12. The compound as claimed in claim 1, wherein its composition, expressed as weight percentages, contains:

45% to 60% of guanidine nitrate,

37% to 52% of basic copper nitrate, and

2% to 4% of said at least one inorganic titanate whose melting point is greater than 2100 K.

13. The compound as claimed in claim 1, wherein said at least one inorganic titanate has a median diameter of less than 1 μm.

14. The compound as claimed in claim 1, wherein its composition, expressed as weight percentages, consists, for at least 99.5% by weight, of:

45% to 60% of guanidine nitrate,

37% to 52% of basic copper nitrate, and

1% to 5% of said at least one inorganic titanate whose melting point is greater than 2100 K.

15. The compound as claimed in claim 1, which consists of:

45% to 60% of guanidine nitrate,

37% to 52% of basic copper nitrate, and

1% to 5% of said at least one inorganic titanate whose melting point is greater than 2100 K.

16. A gas-generating pyrotechnic solid compound, the composition of which contains:

guanidine nitrate, basic copper nitrate, and at least one inorganic titanate whose melting point is greater than 2100 K and having a median diameter of less than 5 μm.

17. The compound of claim 16, wherein said at least one inorganic titanate has a median diameter of less than 1 μm.

* * * * *